US010456005B2

(12) United States Patent
Smith et al.

(10) Patent No.: US 10,456,005 B2
(45) Date of Patent: Oct. 29, 2019

(54) MOP ASSEMBLY

(71) Applicant: Bona AB, Malmo (SE)

(72) Inventors: Dan Smith, Westminster, CO (US); Paul Fair, Denver, CO (US); Jamie Kummerfield, Denver, CO (US)

(73) Assignee: BONA AB, Malmo (SE)

( * ) Notice: Subject to any disclaimer, the term of this patent is extended or adjusted under 35 U.S.C. 154(b) by 275 days.

(21) Appl. No.: 15/479,651

(22) Filed: Apr. 5, 2017

(65) Prior Publication Data

US 2018/0289235 A1 Oct. 11, 2018

(51) Int. Cl.

| | |
|---|---|
| ***A47L 13/20*** | (2006.01) |
| ***A47L 13/51*** | (2006.01) |
| ***B25G 1/08*** | (2006.01) |

(52) U.S. Cl.

CPC ..... *A47L 13/51* (2013.01); *A47L 13/20* (2013.01); *B25G 1/08* (2013.01)

(58) Field of Classification Search

CPC ..... A47L 13/20; A47L 13/51; B25G 1/08

USPC ..... 15/246

See application file for complete search history.

(56) References Cited

U.S. PATENT DOCUMENTS

| | | | | | |
|---|---|---|---|---|---|
| 1,206,010 | A * | 11/1916 | Mackeever | A46B 17/02 | 248/685 |
| 1,228,774 | A * | 6/1917 | Hecht | A46B 17/02 | 248/685 |
| 1,312,178 | A * | 8/1919 | Hill | A46B 17/02 | 248/685 |
| 2,988,768 | A * | 6/1961 | Hill | B44D 3/123 | 15/246 |
| 3,612,464 | A * | 10/1971 | Harrah | A46B 17/00 | 248/110 |
| 5,044,038 | A * | 9/1991 | Matkovic | A46B 17/00 | 15/159.1 |
| 5,406,668 | A * | 4/1995 | Goodhue | A46B 15/00 | 15/143.1 |
| 10,051,952 | B2 * | 8/2018 | Aide | A46B 15/0095 | |

* cited by examiner

*Primary Examiner* — Randall E Chin

(74) *Attorney, Agent, or Firm* — William P. O'Meara; Cochran Freund & Young LLC

(57) ABSTRACT

A mop assembly includes a mop handle having a distal end portion with an exterior surface. The mop assembly also includes a mop suspension member having an exterior surface and an interior surface. The suspension member is mounted on the handle distal end portion and is adapted to suspend the mop from a support structure. The mop suspension member has a seated operating position wherein the exterior surface of the suspension member is positioned substantially entirely within a recessed space that is recessed from the exterior surface of the distal end portion. The suspension member has at least one linearly extended operating position wherein at least a portion of the mop suspension member is positioned outwardly of the recessed space.

16 Claims, 7 Drawing Sheets

MOP ASSEMBLY

BACKGROUND

Many modern floor mops include an elongate handle that is pivotally attached to a mop head. Generally, a mop pad made from fabric material is removably attached to the mop head and may be easily removed for cleaning or replacement. More recently, some floor mops had been provided with liquid dispensing systems that allow floor cleaner, floor polish or the like, to be dispensed from the mop as it moves across the floor.

SUMMARY

A mop assembly includes a mop handle having a distal end portion with an exterior surface. The mop assembly also includes a mop suspension member having an exterior surface and an interior surface. The suspension member is mounted on the distal end portion of the handle and is adapted to suspend the mop from a support structure. The mop suspension member has a seated operating position wherein the exterior surface of the suspension member is positioned substantially entirely within a recessed space that is recessed from the exterior surface of the distal end portion. The suspension member has at least one linearly extended operating position wherein at least a portion of the mop suspension member is positioned outside the recessed space. operating A mop assembly includes a handle having an exterior surface and a generally U-shaped member with an exterior surface that is mounted on the handle. The generally U-shaped member has a seated operating position wherein the exterior surface of the generally U-shaped member is substantially flush with the exterior surface of the handle. The generally U-shaped member has a first displaced operating position wherein the generally U-shaped member is linearly displaced relative the seated operating position. The generally U-shaped member also has a second displaced operating position wherein said U-shaped member is rotatably displaced relative the first displaced operating position.

A method of supporting a mop on a support structure includes linearly displacing the mop support member relative a mop handle. The method also includes rotatably displacing the support member relative the mop handle. The method further includes placing the mop support member in engagement with the mop support structure.

DETAILED DESCRIPTION

Figure 1:
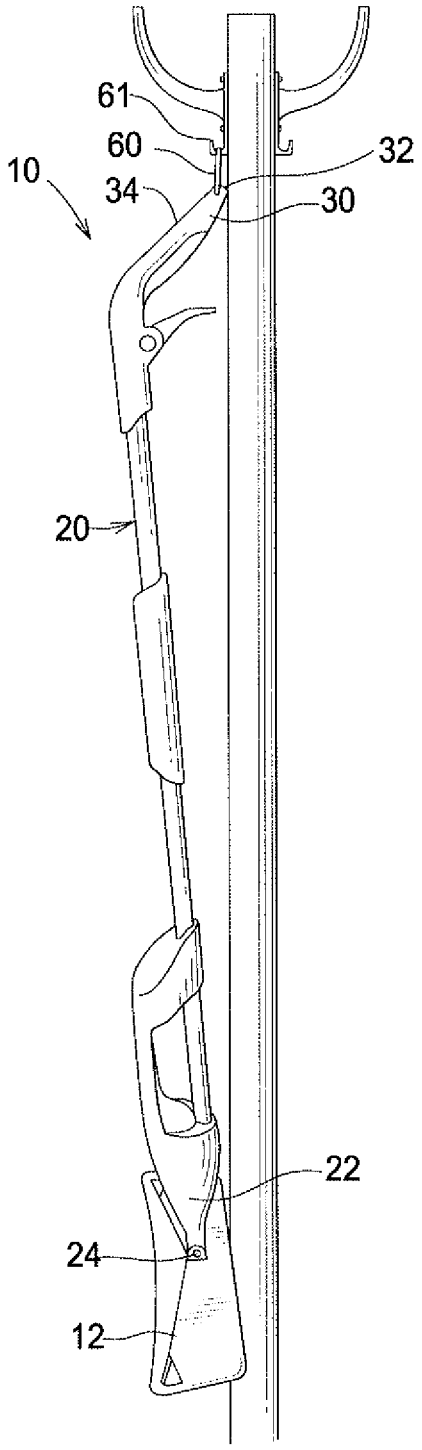
FIG. 1 is an isometric view of a floor mop assembly suspended from a support structure by a floor mop suspension member located in a fully linearly extended and rotated operating position.

FIG. 1 is an isometric view of a floor mop assembly 10 suspended from a support structure such as a hook 61 on a support stand or wall. The floor mop assembly 10 may include a mop head 12 that may be adapted to receive a conventional mop pad (not shown). A mop handle 20 has a proximal end portion 22 connected to the mop head 12, as by a conventional pivot assembly 24. The mop handle has a distal end portion 30, which terminates in a distal end tip 32.

Figure 2:
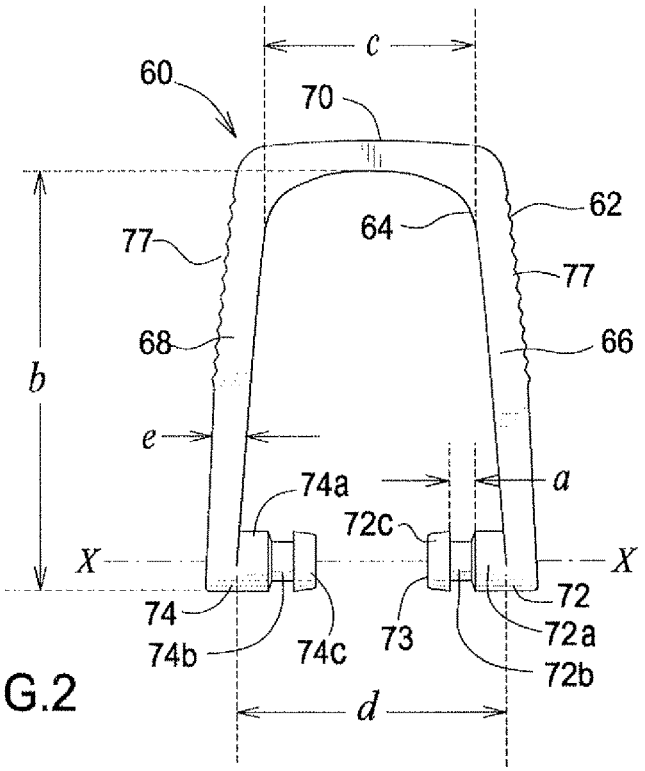
FIG. 2 is a side elevation view of the suspension member shown in FIG. 1.

FIG. 2 is a magnified view of the suspension member 60, which has an exterior surface 62 and an interior surface 64. The suspension member 60 may be constructed from a resilient material, such as high strength plastic or spring steel. Suspension member 60 has a generally U-shaped configuration including opposite first and second arm portions 66, 68, connected at proximal ends thereof to a central body portion 70. The arm portions 66, 68 flare outwardly. In one embodiment, each arm portion 66, 68 has a length "b" of about 1.5 in and the central body portion 70 has a length "c" of about 0.7 in.

A first stud portion 72 extends inwardly from the distal end of arm portion 66. The stud portion 72 has a relatively large diameter inner end 72*a*, which may have a diameter of about 0.2 in and an axial length of about 0.1 in. The first stud portion 72 has a relatively small diameter intermediate portion 72*b*, which may have a diameter of about 0.1 in and an axial length of about 0.1 in. The stud portion 72 has a relatively large diameter terminal end portion 72*c*, which may have a diameter of about 0.2 in and an axial length of about 0.1 in. A second stud portion 74 extends inwardly from the distal end of arm portion 68 and may be the mirror image of stud portion 72 with corresponding portions 74*a*, 74*b*, and 74*c*.

The distance "d" between the distal ends of the arm portions 66, 68, as measured between opposite ends of the inner surface 64 of the arm portions 66, 68, is about 1.1 in. The arm portions 66, 68 of the generally U-shaped suspension member 60 may be separated by a distance "c" of about 0.8 in at the point where they are attached to the central body portion 70.

The exterior surface 62 of the suspension member 60 may include a grooved or otherwise roughened surface 77 on each arm portion 66, 68 to facilitate finger gripping and pulling the suspension member to displace it. Each arm portion 66, 68 may have a thickness of about 0.1 in. The dimensions of the U-shaped member 60 provided above are merely example dimensions of one embodiment of the U-shaped member. The U-shaped member 60 may have other dimensions in other embodiments.

Figure 3:
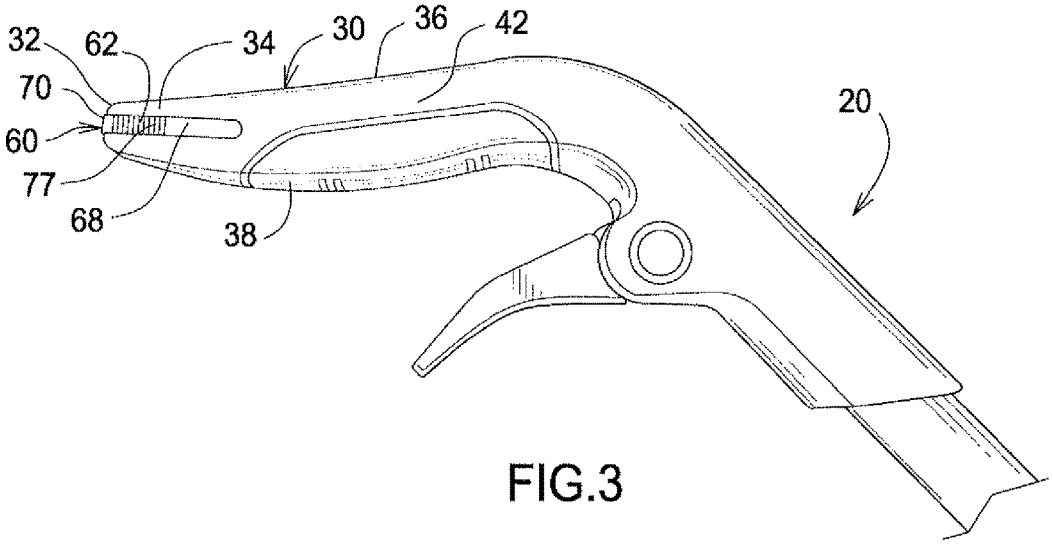
FIG. 3 is a bottom/side perspective view of a distal end portion of the floor mop handle of FIG. 1, with the floor mop suspension member located in a seated operating position.

FIG. 3 is a side elevation view of the distal end portion 30 of the mop handle 20. The distal end portion 30 terminates in a relatively narrow tip portion 32. The distal end portion 30 has an exterior surface 34 including an upper surface portion 36, a lower surface portion 38, and first and second lateral side surface portions 42, 44. (Only lateral side surface portion 42 is shown in FIG. 3.)

Figure 4:
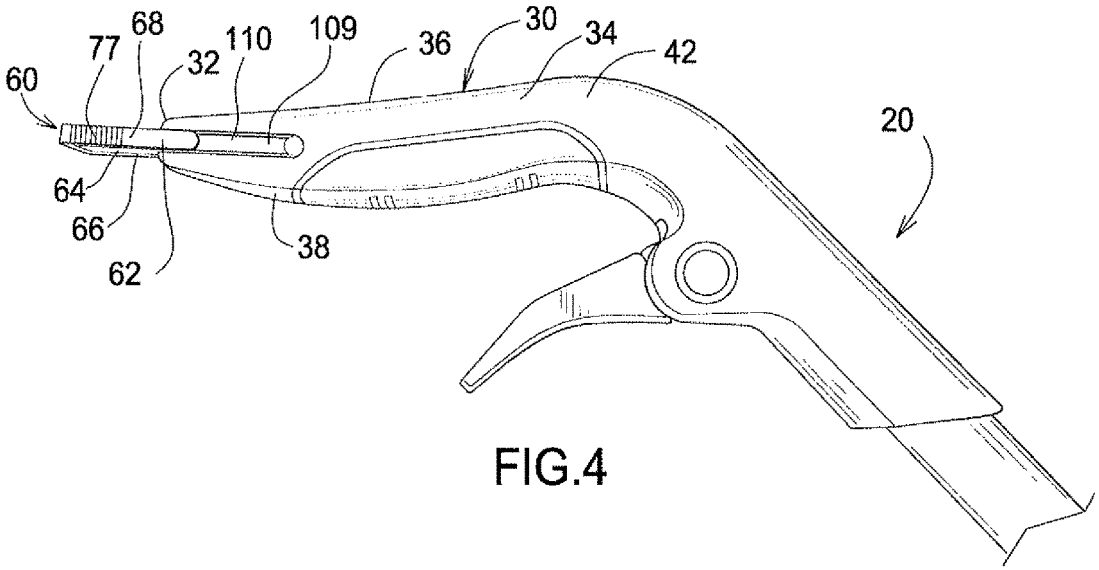
FIG. 4 is a side elevation view of the distal end portion of the mop handle with the floor mop suspension member located in a fully linearly extended operating position.

FIG. 3 shows the floor mop suspension member 60 mounted in the distal end portion 30 in a seated operating position within a recessed space 110, FIG. 4, of the distal end portion 30. In this seated operating position, the exterior surface 62 of the suspension member is substantially flush with the exterior surface 34 of the distal end portion 30. This seated operating position is the operating position that the suspension member 60 normally occupies when the mop assembly 10 is in use in mopping operations. The flush relationship between the exterior surface 34 of the distal end portion 30 and the exterior surface 62 of the suspension member 60 provides a continuous smooth surface to grip during normal mopping operations. The suspension member 60 and the recessed space 110 that receives the suspension member 60 are constructed and arranged such that friction between the mop handle distal end portion 34 and the suspension member 60 maintains the suspension member 60 in the seated operating position, FIG. 3, while the mop assembly 10 is in normal use.

FIG. 4 is a side elevation view of the distal end portion 30 of the handle 20 shown in FIG. 3 with the floor mop suspension member 60 in a full linearly extended operating position within recessed space 110. The suspension member is moved into this operating position from its seated operating position shown in FIG. 3 by finger gripping the grooved surfaces 77 of the arm portions 66, 68 and pulling the suspension member linearly outwardly. During this linear displacement of the suspension member 60, it is prevented from rotating about its rotation axis XX (FIG. 2) by the peripheral surfaces that define the recessed space 110, until the suspension member has been moved into the fully extended operating position shown in FIG. 4.

Figure 5:
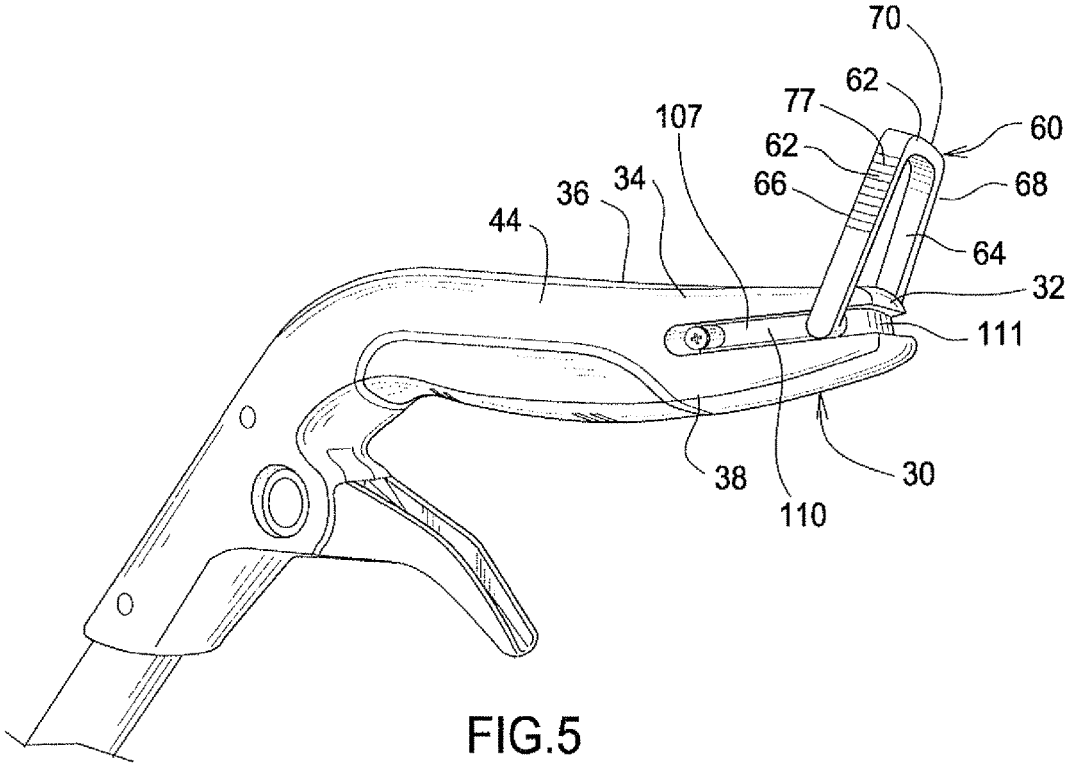
FIG. 5 is a side elevation view of the distal end portion of the handle with the floor mop suspension member in a fully linearly extended and rotated operating position.

The recessed space 110, as best shown by FIGS. 4 and 5 conforms to the shape of the U-shaped suspension member 60, i.e., recessed space 110 is generally U-shaped and has a depth equal to the thickness of the generally U-shaped member 60. The recessed space comprises opposite linear portions 107, 109 located on the opposite lateral sides of the distal end portion 30. Opposite linear portions 107, 109 are, like the surface portions of the distal end portion 30 that are adjacent to linear portions 107, 109, slightly skewed, such that the distance between the two linear portions 107, 109 is smallest at the tip 32 of the distal end portion 30 and is largest at the opposite end of the recessed space 110. The recessed space 110 further includes a transversely extending portion 111, FIG. 5, connecting opposite linear portions 107, 109. This transversely extending portion 111 of the recessed space 110 is adapted to receive the central body portion 70 of the suspension member 60 when it is in the seated operating position shown in FIG. 3. The opposite linear portions 107, 109 of the recessed space 110 are adapted to receive the arm portions 66, 68 of the suspension member 60.

FIG. 5 is a side elevation view of the handle distal end portion 30 with the floor mop suspension member 60 in a full linearly extended and rotated operating position. Rotation of the suspension member 60 is possible when the suspension member is in the fully linearly extended operating position shown in FIG. 4, because the lateral dimension of the upper half of the tip portion 32 is less than the distance between corresponding locations of the suspension member arm portions 66, 68. The suspension member 60 is thus free to rotate upwardly to the angle shown in FIG. 5 and slightly beyond, until the gradually increasing width of the distal end tip portion 32 causes the suspension member 60 to frictionally engage the exterior surface 34 of the distal end tip portion 32 preventing further rotation of the U-shaped member 60.

Figure 6:
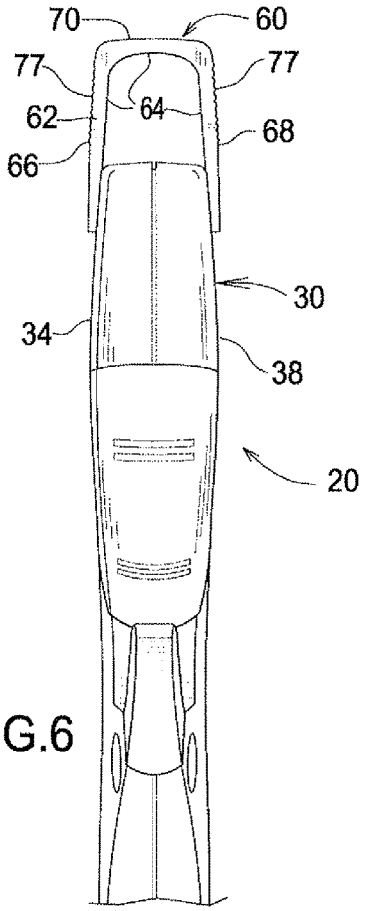
FIG. 6 is a bottom view of the distal end portion of the handle shown in FIGS. 2-4 with the floor mop suspension member in the a fully linearly extended operating position.

FIG. 6 is a bottom view of the distal end portion 30 of the handle 20 with the floor mop suspension member 60 in a full linearly extended operating position.

Figure 7:
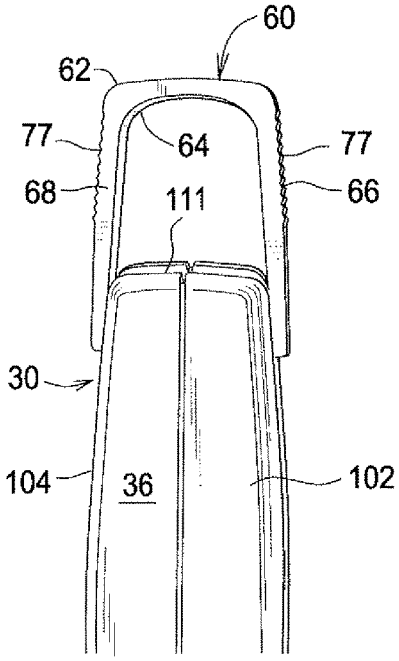
FIG. 7 is a top perspective view of the distal end portion of the handle with the floor mop suspension member in a fully linearly extended operating position.

FIG. 7 is a detail top perspective view of the distal end portion 30 of the handle 20. The floor mop suspension member 60 in a full linearly extended operating position.

Figure 8:
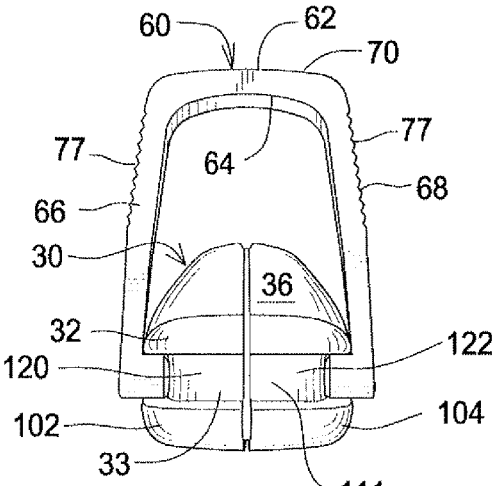
FIG. 8 is a top/end perspective view of the distal end portion of the handle with the floor mop suspension member in a fully linearly extended and rotated operating position.

FIG. 8 is a detail top/end perspective view of the distal end portion 30 of the handle 12 with the floor mop suspension member 60 in a fully linearly extended position. The transversely extending portion 111 of the recessed space 110 is clearly shown in this view.

Figure 9:
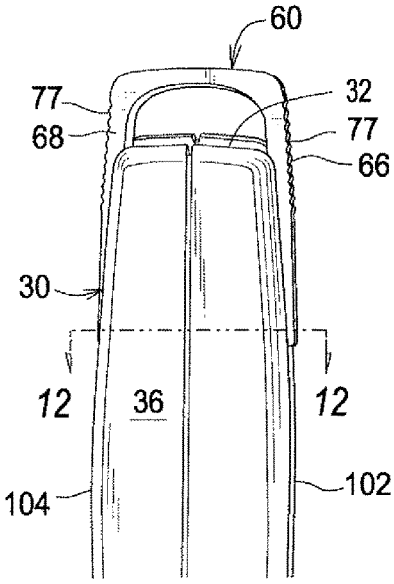
FIG. 9 is a top perspective end view of the distal end portion of the handle with the floor mop suspension member in a full linearly extended and rotated operating position.

FIG. 9 is a detail top perspective view of the distal end portion of the handle 20 with the floor mop suspension member 60 in a partially linearly extended and rotated operating position. From this operating position, the suspension member cannot rotate because it will contact edge portions of the handle defining the recessed space 110.

Figure 10:
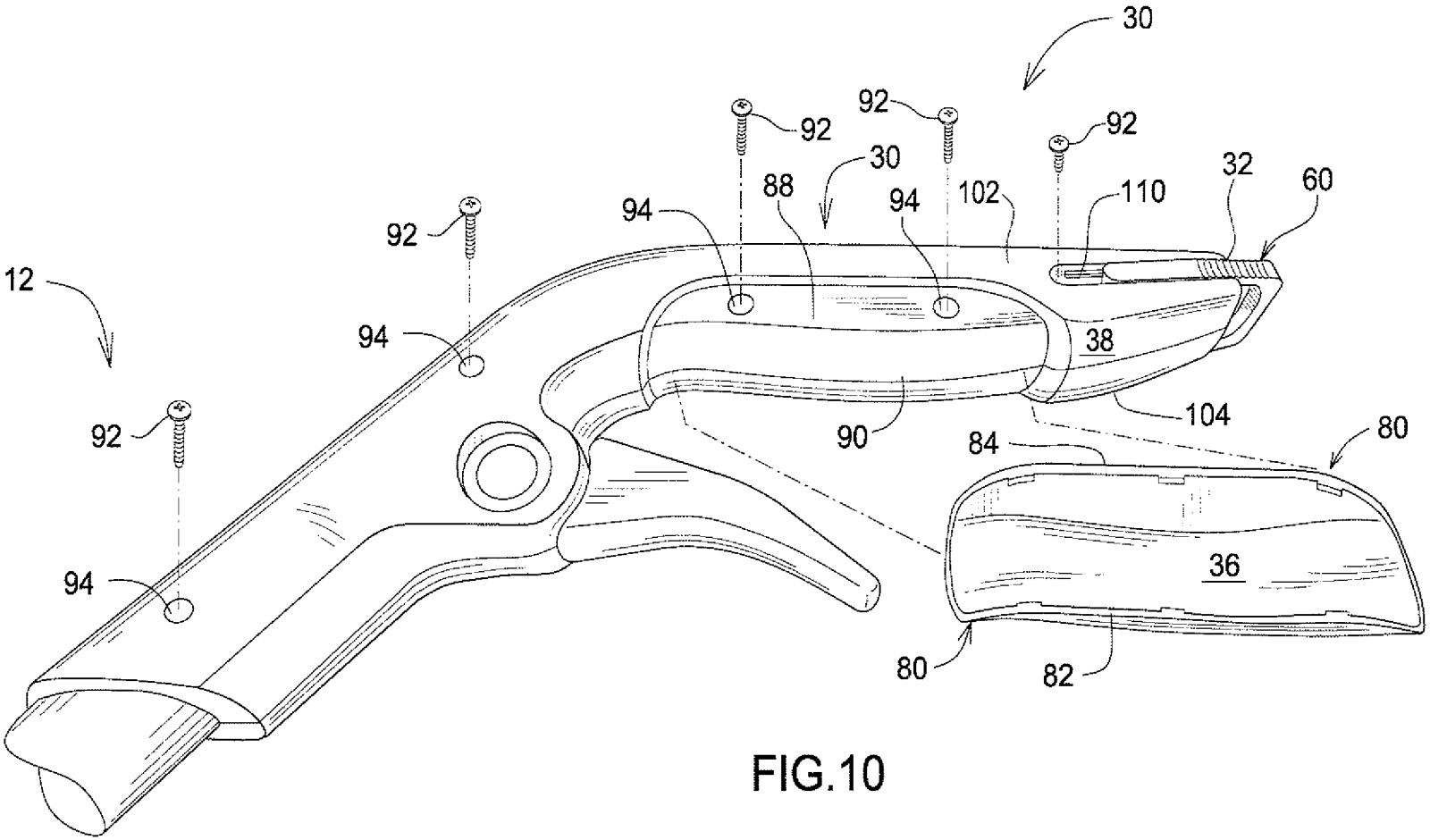
FIG. 10 is a partially disassembled perspective view of the distal end portion of the handle shown in FIGS. 2-8 with the floor mop suspension member in a partial linearly extended operating position.

FIG. 10 is a partially disassembled perspective view of the distal end portion 30 of the handle. The suspension member 60 is in a partially linearly extended operating position. A cover member 80, which normally frictionally engages the distal end portion 30 of the handle member 12 has been removed exposing screw holes 94. Screw holes 94 receive screws 92 that hold two mirror image halves 102, 104 of the distal end portion 30 together.

Figure 11:
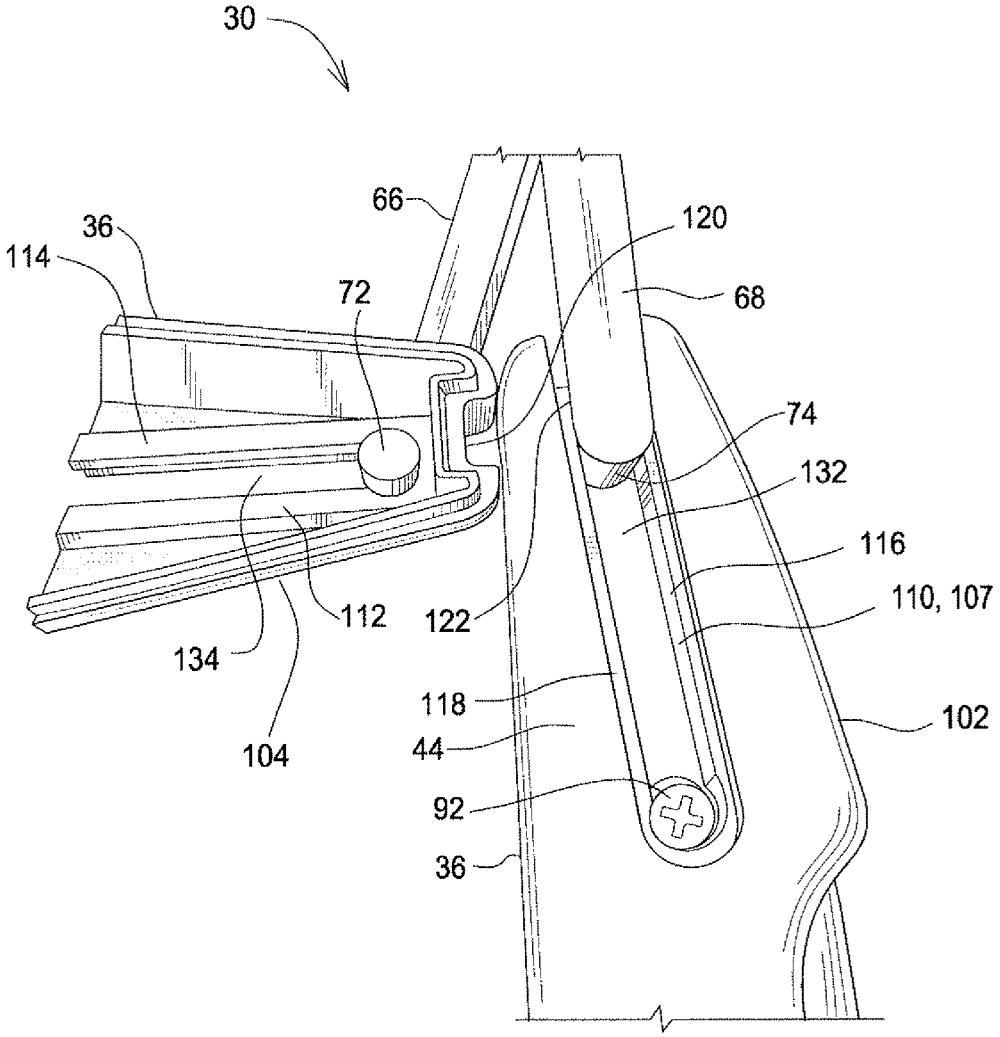
FIG. 11 is a detail perspective view of the distal end portion of the handle with separate halves of the distal end portion separated and with the floor mop suspension member resiliently deformed and in a full linearly extended operating position within each of the separate halves.

FIG. 11 is a detail perspective view of the distal end portion 30 of the handle with separate halves 102, 104 of the distal end portion 30 separated. The floor mop suspension member 60 remains attached to both halves 102, 104, but is resiliently deformed due to the separation of the two halves. The suspension member arm portions 66, 68 occupy the same positions within the linear portions 107, 109 of the recessed space 110 that are occupied when the suspension member 60 is in the fully linearly extended position shown in FIG. 4.

With continued reference to FIG. 11, one half 102 of the distal end portion 30 comprises an upwardly projecting rail portion 116 and an opposed downwardly projecting rail portion 118 that define an elongate slot 132. The other half 104 of the distal end portion 30 comprises an upwardly projecting rail portion 112 and an opposed downwardly projecting rail portion 114 that define an elongate slot 134. Elongate slot 134 is positioned laterally opposite elongate slot 132 when the two halves 102 and 104 are assembled. The inwardly extending stud portions 72, 74 of the suspension member 60 slide freely within these slots 132, 134, and are retained in the slots 132, 134 due to the enlarged outer ends 72*c*, 74*c*, FIG. 2, and enlarged inner ends 72*a*, 74*a* of the stud portions 72, 74 that are positioned on opposite sides of the associated rail portions 112, 114, 116, 118. Stud portions 72*b*, 74*b* slide on respective opposed rail portions 112, 114 and 116, 118, FIG. 11. Arm portions 66, 68, of the generally U-shaped suspension member 60 slide in the opposed linear portions 107, 109, FIGS. 4 and 5, of the generally U-shaped recessed space 110. Each of the two halves 102, 104 of the distal end 30 comprises a transverse rib 120, 122, FIGS. 8 and 11 that collectively act as a stop that limits the movement of the support member 60.

Figure 12:
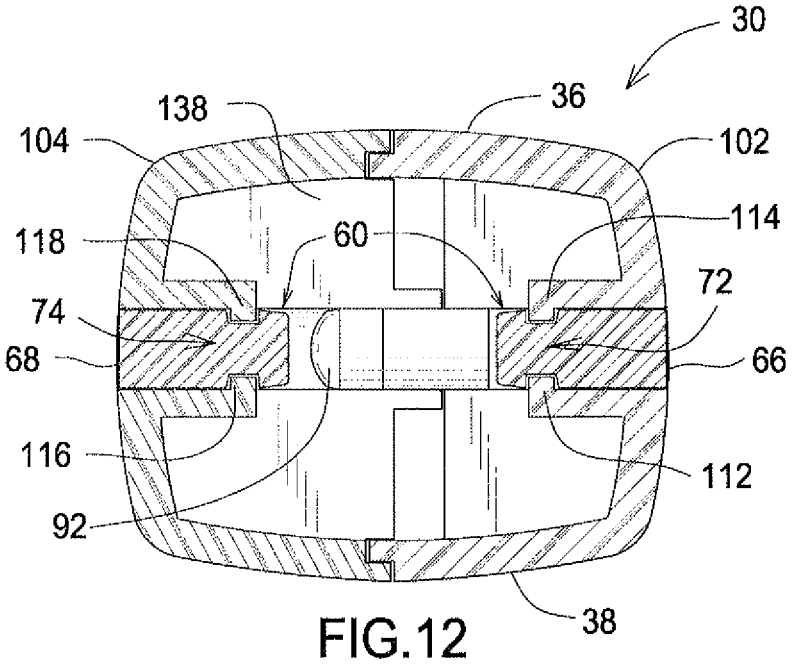
FIG. 12 is a cross sectional end view of the handle distal end portion taken along the cutting plane shown in FIG. 9.

FIG. 12 is a cross sectional end view of the handle distal end portion taken along the cutting plane shown in FIG. 9. This view illustrates the respective halves 102, 104 and associated rail portions 112, 114 and 116, 118 and arm portions 66, 68 of the suspension member. Stud portions 72, 74 of the arm portions 66, 68 slide along the rail pairs 112, 114 and 116, 118. The distal end portion 30 may have an interior wall 138, half of which is formed in each handle half 102, 104. The two halves each have a corresponding threaded bump-out portion adapted to threadingly receive a machine screw 92 therein to hold the two halves together.

Figure 13:
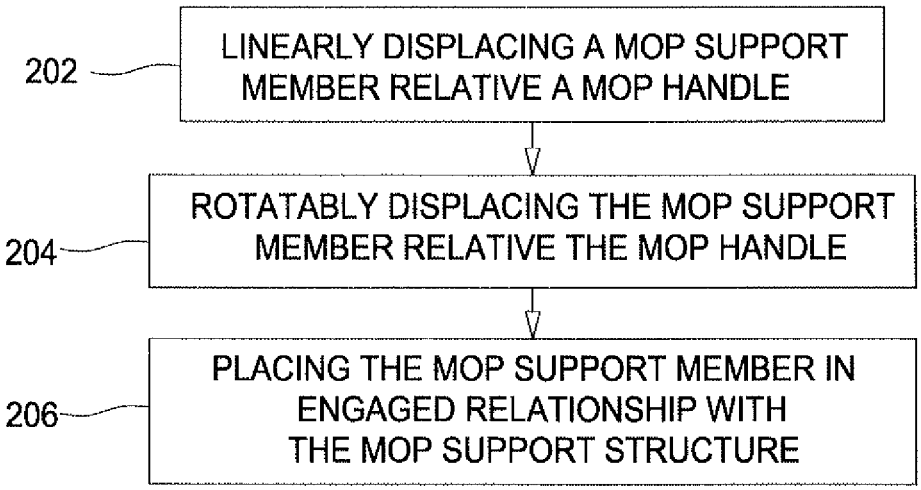
FIG. 13 is a flow diagram of a method of supporting a mop on a support structure.

FIG. 13 illustrates a method of supporting a mop on a support structure. The method includes, as shown at block 202, linearly displacing mop support member relative a mop handle. The method also includes, as shown at block 204, rotatably displacing the support member relative the mop handle. The method further includes, as shown at block 206, placing the mop support member in engagement with the mop support structure.

Specific embodiments of a mop assembly including a mop handle having a linearly and rotatably displaceable suspension member are described in detail in this disclosure. Alternative embodiments of such a mop assembly may occur to those skilled in the art after reading this disclosure. It is intended that the language of the claims be broadly construed to cover all such alternative embodiments, except to the extent limited by the prior art.

What is claimed is:

1. A mop assembly comprising:

a mop handle having a distal end portion with an exterior surface;

a mop suspension member having an exterior surface and an interior surface and being mounted on said handle distal end portion and adapted to suspend said mop from a support structure; said mop suspension member comprising:

a seated operating position wherein said exterior surface of said suspension member is positioned substantially entirely within a recessed space that is recessed from said distal end portion exterior surface; and at least one linearly extended operating positions wherein at least a portion of said mop suspension member is positioned outside of said recessed space;

said mop suspension member and said handle distal end defining a closed loop when said suspension member is in said extended operating position.

2. The mop assembly of claim 1 said mop suspension member being linearly displaceable relative said handle.

3. The mop assembly of claim 2, said mop suspension member being rotatably displaceable relative said handle.

4. The mop assembly of claim 1, said mop suspension member being rotatably displaceable relative said handle.

5. The mop assembly of claim 1, said mop suspension member being linearly and rotatably displaceable relative said handle.

6. The mop assembly of claim 1, said mop suspension member comprising a generally U-shaped configuration.

7. The mop assembly of claim 1, said handle distal end having a recessed space therein, said mop suspension member being displaceably mounted in said recessed space.

8. The mop assembly of claim 7, at least a portion of said mop suspension member being linearly and rotatably mounted within said recessed space.

9. The mop assembly of claim 7, said recessed space comprising opposite elongated portions on opposite sides of said handle distal end.

10. The mop assembly of claim 7 said recessed space being at least partially defined by opposite interior surfaces of said handle distal end.

11. The mop assembly of claim 10 wherein said opposite interior surfaces of said handle member define a linear displacement path of said mop suspension member.

12. The mop assembly of claim 11 wherein said opposite interior surfaces of said handle member define a linear displacement path of said mop suspension member comprise linear rail surfaces.

13. The mop assembly of claim 12 wherein said linear rail surfaces partially define a seating region in which said mop suspension member is received while in said seated position.

14. The mop assembly of claim 13, said mop suspension member comprising a generally U-shaped configuration comprising opposite arm portions and a central body portion, each of said arm portions having a proximal end connected to said central body portion and a distal end.

15. The mop assembly of claim 14, each of said opposite arm portions being connected at distal ends thereof to an inwardly extending rail follower stud portion adapted to slide along at least an associated one of said linear rail surfaces.

16. The mop assembly of claim 15, said inwardly extending rail follower stud portions each comprising a laterally extending axis, said U-shaped member being rotatable about said laterally extending axes of said inwardly extending rail follower stud portions.

* * * * *